United States Patent [19]

Dosaka

[11] Patent Number: 4,491,281

[45] Date of Patent: Jan. 1, 1985

[54] METHOD AND APPARATUS FOR WINDING WIRES

[75] Inventor: Akira Dosaka, Koganei, Japan

[73] Assignee: Ikari Machine Tools Co., Ltd., Tokyo, Japan

[21] Appl. No.: 525,594

[22] Filed: Aug. 23, 1983

[30] Foreign Application Priority Data

| | | | |
|---|---|---|---|
| Sep. 13, 1982 | [JP] | Japan | 57-159295 |
| Apr. 20, 1983 | [JP] | Japan | 58-70543 |
| Apr. 20, 1983 | [JP] | Japan | 58-70544 |
| Apr. 28, 1983 | [JP] | Japan | 58-74106 |

[51] Int. Cl.[3] ..... B65H 81/02; H01F 41/08

[52] U.S. Cl. ..... 242/4 R; 242/7.03; 29/605

[58] Field of Search ..... 242/4 R, 7.03; 29/605

[56] References Cited

U.S. PATENT DOCUMENTS

| | | | |
|---|---|---|---|
| 2,620,183 | 12/1952 | Kyle et al. | 226/106 X |
| 2,891,735 | 6/1959 | Müller | 242/4 R |
| 2,962,235 | 11/1960 | Ridler et al. | 242/4 R |
| 3,128,955 | 4/1964 | Stütz | 242/4 R |
| 4,424,939 | 1/1984 | Ohashi et al. | 242/4 R |

OTHER PUBLICATIONS

Pneumatic Core Winding Apparatus, IBM Technical Disclosure Bulletin, vol. 10, No. 7, Dec. 1967, pp. 950, 951.

*Primary Examiner*—Stuart S. Levy
*Assistant Examiner*—Joseph J. Hail, III
*Attorney, Agent, or Firm*—Flynn, Thiel, Boutell & Tanis

[57] ABSTRACT

A thin electric wire is wound as a coil around a core through a small-diameter hole defined therein. The wire is threaded through the hole on an air stream flowing through the hole which is vacuum generated. Since the wire is drawn into the hole by the air flow, the wire is not required to be positioned correctly with respect to the core hole. After the wire has been inserted through the core hole, the wire enters a suction pipe and is wound around the core by turning movement of the suction pipe. When the wire is to be threaded through the core hole again, the distal end of the wire is positioned and cut off. A cut end of the wire is positioned substantially centrally of the core hole. Thereafter, a vacuum is developed again in the suction pipe to draw the wire through the core hole. The wire is thus wound around the core in as many coil turns as desired.

12 Claims, 22 Drawing Figures

4491281

METHOD AND APPARATUS FOR WINDING WIRES

BACKGROUND OF THE INVENTION

The present invention relates to a method of and an apparatus for automatically winding a thin electric wire in a small hole in a toroidal core.

Heads in video tape recorders, for example, are in the form of a disk having a plurality of cores on its outer peripheral edge. Each core has a small-diameter hole with a thin electric wire of a diameter on the order of 0.03 mm being wound as a coil therein. The coils in the holes serve to convert magnetically recorded signals into electric signals when a magnetic tape is traced by the head.

It has been conventional practice to manually wind the electric wire in the core hole while observing the core hole at an optically magnified scale. The manual wire winding however is disadvantageous in that wire coils are fabricated at a poor production rate, cannot be mass-produced, and thus are highly expensive. Under the circumstances, there has been a demand for automatized wire winding operation.

SUMMARY OF THE INVENTION

It is an object of the present invention to provide a method of and an apparatus for winding an electric wire in a core hole at a high speed in an automatized process through a combination of mechanical movable parts and pneumatic means for inserting the wire through the core hole.

To achieve the above object, an electric wire is threaded through a hole in a core into a suction pipe by an air stream created under a vacuum developed in the suction pipe. Thereafter, the distal end of the wire is corrected rectilinearly and positioned, and then guided into the core hole. While the wire is being wound around the core through the hole, the intermediate portion of the wire is forced in its free state by an air flow to be oriented in a prescribed direction, so that the wire will be prevented from being entangled with surrounding machine parts. The wire threaded through the core hole is held by a pair of frictional holder means disposed at a distal end of the suction pipe, and wound neatly around the core while under tension. At the same time, the wire is corrected rectilinearly out of any tendency thereof to turn or curl by the frictional holder means through frictional sliding engagement therewith.

When the suction pipe is turned around to wind the wire, a tube for transmitting a vacuum into the suction tube would move with the suction pipe. The movement of the suction pipe would then be limited by the tube. The suction pipe would not be moved at a high speed due to the weight of the tube.

Accordingly, another object of the present invention is to separate the swingable suction pipe and the tube for transmitting a vacuum into the suction pipe, thereby removing undesired obstacles to movement of the suction pipe. To accomplish this object, a suction tube is attached in position and has a sucker on its distal end. The sucker is elastically deformable into and out of contact with the suction pipe in response to a change in pneumatic pressure generated by a vacuum source.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
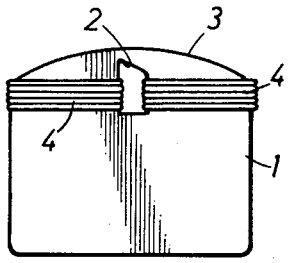
FIG. 1 is a plan view of a core.
Figure 2:
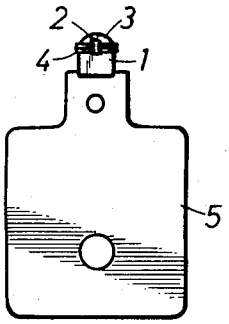
FIG. 2 is a plan view of a core base and the core mounted thereon.

FIG. 1 illustrates a core 1 in the form of a plate made of ferrite having a thickness of about 0.4 mm and a width and a length which are both in the range of from 2 through 3 mm. The core 1 has a curved tracing surface 3 and a hole 2 defined adjacent to the tracing curface 3, the hole 2 being 0.3 mm or less across. Electric wires 4 having a diameter of about 0.03 mm are wound as coils extending through the hole 2 across marginal edges of the core 1 one on each side of the hole 2. Dependent on the final product, each of the wire coils has coil turns ranging from 5 through 15. As shown in FIG. 2, the toroidal core 1 is bonded or otherwise attached to a distal end of a core base 5. The toroidal core 1 is mounted by the core base 5 to an outer peripheral edge of a head (not shown).

Figure 3:
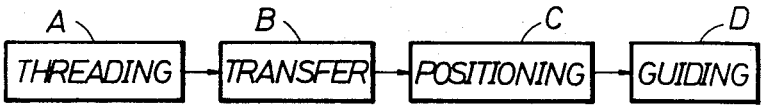
FIG. 3 is a diagram illustrating a process of sequential steps of winding an electric wire.
Figure 4:
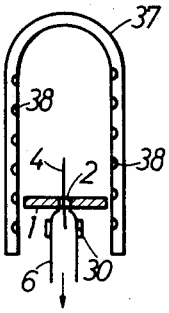
FIGS. 4 through 9 are views showing the winding process in successive steps.

FIG. 3 shows a process of progressive steps of winding an electric wire. The process is carried out by a winding apparatus 11 as shown in FIG. 10 according to the present invention. This winding process is generally composed of a threading step A, a transfer step B, a positioning step C, and a guiding step D. FIG. 4 shows the threading step A, FIGS. 5, 6 and 7 the transfer step B, FIG. 8 the positioning step C, and the FIG. 9 the guiding step D.

In the threading step A, as illustrated in FIG. 4, the starting end of an electric wire 4 having a prescribed length is guided from one side of the core 1 closely to the hole 2 on that side. Then, the distal end of a suction pipe 6 is brought closely to a central portion of the hole 2 on an opposite side of the core 1 until the pipe end is held in intimate contact with an edge around the hole 2. The suction pipe 6 now draws air to create a vacuum therein for thereby producing an air stream axially through the hole 2. The air stream draws therewith the end of the electric wire 4 through the hole 2 until the electric wire 4 is introduced into the suction pipe 6. During this suction process, an air current flows into the hole 2 from a surrounding space on the side of the core 1 in which the wire 4 is originally positioned. Therefore, the end of the wire 4 may be located roughly in the vicinity of the hole 2, and need not be critically positioned with respect to the hole 2. The end of the wire 4 is thus threaded on the suction-activated air stream through the hole 2 in the core 1.

Figure 5:
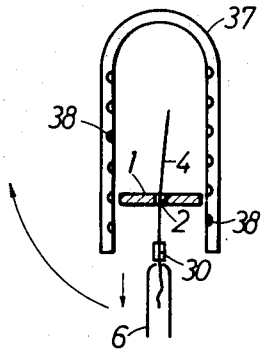
Figure 6:
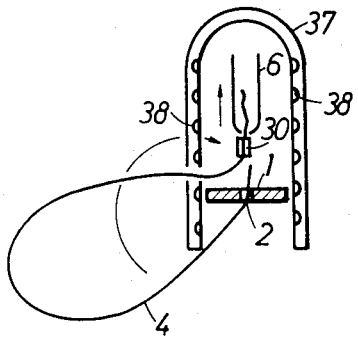
Figure 7:
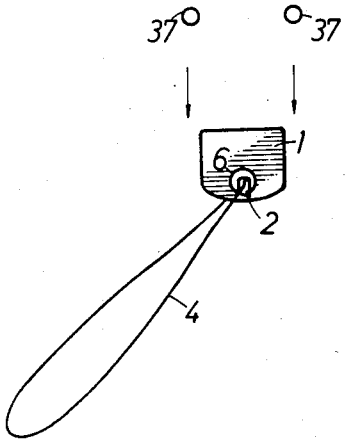

As shown in FIG. 5, the following transfer step B enables the suction pipe 6 to be retracted away from the core 1 while the wire 4 is being frictionally gripped by a pair of holder members 30 of rubber. Then, the suction pipe 6 is moved around the core 1 from one side to the other thereof as shown in FIG. 6, during which time the suction pipe 6 is inverted. The wire 4 is now transferred into a direction in which it is to be wound around the core 1. At this time, wire 4 is frictionally slid on the holder members 30 while the latter impose a certain tension on the wire 4, with the result that the wire 4 is corrected rectilinearly and wound nearly along surfaces of the core across edges thereof. The suction pipe 6 is turned around an axis positioned closely to the hole 2 in the core 1. After the suction pipe 6 has been turned upside down, it is slightly moved upwardly and has drawn about 5 cm of the distal end of the wire 4. During this transfer interval, an air blower pipe 37 discharges air streams through its air discharge ports 38 to direct and position the looped wire 4 out of entangling engagement with surrounding machine parts.

Figure 8:
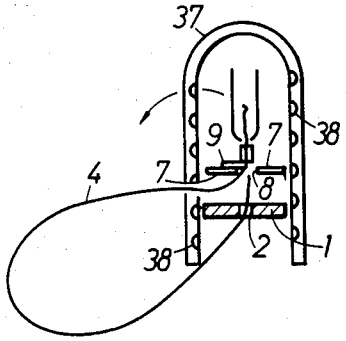
Figure 13:
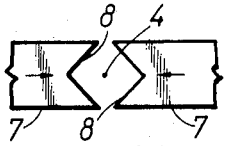
FIGS. 13 and 14 are plan views of grippers.
Figure 14:
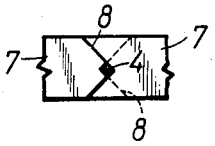
Figure 15:
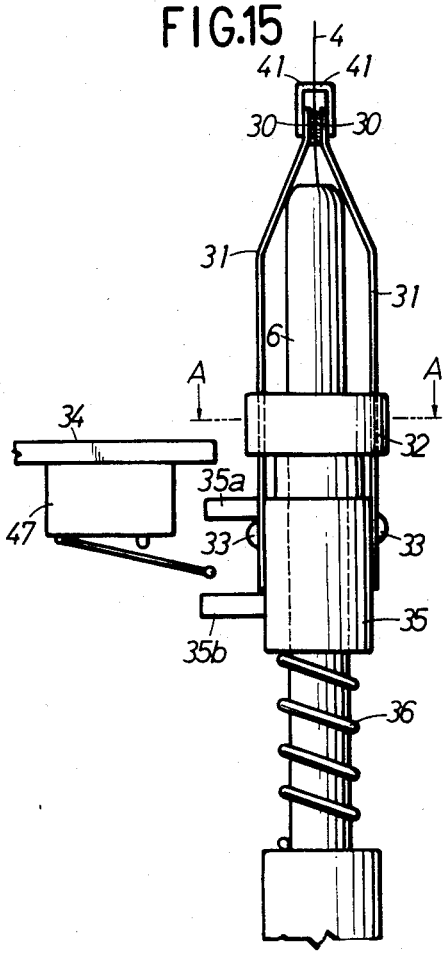
FIGS. 15 and 16 are enlarged side elevational views of a suction pipe.

In the next positioning step C, as shown in FIG. 8, a pair of grippers 7 is moved toward the lower end of the suction pipe 6, and grips the distal end of the wire 4 with V-shaped grip surfaces 8 (FIGS. 13 and 14). Simultaneously, the distal end of the wire 4 is severed by a cutter 9. Since the distal end of the wire 4 is gripped by the gripper 7 on the central axis of the hole 2, the wire end is rectilinearly corrected and properly positioned in alignment with the hole 2. The distal end of the wire 4 which is drawn in the suction pipe 6 tends to be bent into a complex shape due to vibrations caused by the suction in the suction pipe 6. Such distal end of the wire 4 however is cut off, and the cut end of the wire 4 is positioned accurately in axial alignment with the hole 2. The prescribed length of the wire 4 is selected to be the sum of a length required to be wound on the core 1 and a length to be cut off by the cutter 9.

Figure 9:
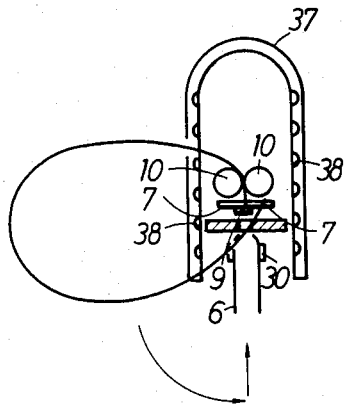
Figure 10:
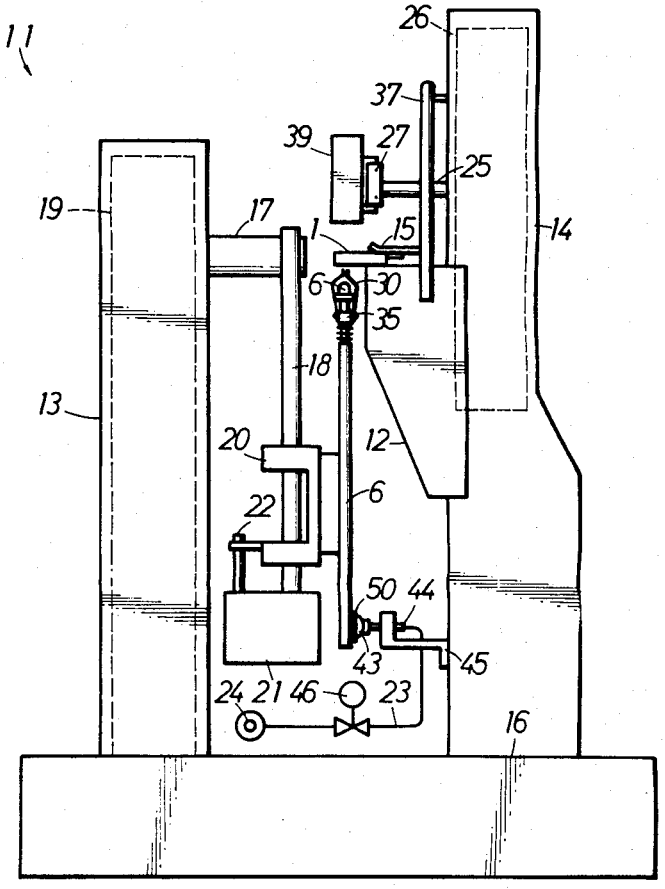
FIG. 10 is a front elevational view of a winding apparatus according to the present invention.
Figure 11:
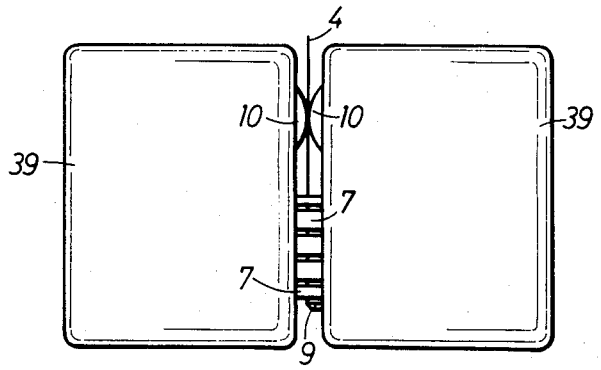
FIG. 11 is an enlarged front elevational view of a head in the winding apparatus.

During the final guiding step D, as shown in FIG. 9, the grippers 7 are turned upside down while moving downwardly to allow the cut end of the wire 4 to be directed toward the hole 2. Then, the suction pipe 6 returns to the other side of the core 1, that is, downwardly of the core 1, and starts again to draw air to create a vacuum therein. The threading step A is now started again. At this time, the grippers 7 are actuated to release the distal end of the wire 4. A pair of feed rollers 10 may be provided as desired for feeding the wire 4 toward the hole 2. The wire 4 is thus wound around the core 1 through the hole 2.

The foregoing cycle of steps is successively repeated as many times as there are coil turns to be made of the wire 4.

The foregoing winding method is advantageous for mechanizing the wire winding operation for the following reasons: In the threading step A, the air stream flowing into the hole 2 carries the end of the wire 4 from one side to the other side of the core 1 through the hole 2, and no particular positioning is required of the end of the wire 4. During the transfer step B, the wire 4 is frictionally and slidably clamped by the holder members 30 and thus tensioned so as to be corrected out of any undesired tendency to curl around. Since any bent distal end of the wire 4 is severed by the cutter 4 in the positioning step C, the cut end of the wire 4 to be inserted in the hole 2 is not disoriented out of axial alignment with the hole 2. Therefore, the wire 4 can uniformly be threaded through the hole 2. The cut end of the wire 4 is gripped and positioned properly by the grippers 7 as they are moved back and forth, and no other means for positioning the distal end of the wire 4 is necessary. As a consequence, the wire 4 can be wound on the core 1 more quickly and smoothly on a mechnized basis than on a manual basis.

FIGS. 10 through 22 illustrate the winding apparatus 11 of the present invention for carrying out the foregoing winding method. The winding apparatus 11 generally comprises a holder 12, a transfer device 13, and a guide device 14 in addition to the suction pipe 6, the grippers 7, the cutter 9, the holder members 30 and the air blower pipe 37.

The holder 12 is attached to a side of the guide unit 14 for supporting the core 1 on an upper surface thereof, the core 1 being detachably fixed in position by a resilient presser plate 15. The transfer device 13 serves to cause the suction pipe 6 to swing into the direction in which the wire 4 is to be wound while inverting the suction pipe 6. The transfer device 13 is mounted on a base 16 and has a rotatable shaft 17 and an arm 18 which supports the suction pipe 6 in a vertical sense. The rotatable shaft 17 is driven by a drive mechanism 19 to turn through 180° for inverting the suction pipe 6. The suction pipe 6 has a tapered suction port 40 in a distal end thereof and is slidably mounted by a slider 20 on the arm 18. The slider 20 is drivable by a drive unit 21 and a drive rod 22 which are attached to a distal end of the arm 18. The air blower pipe 37 is part of the transfer device 13 and in the form of an inverted U. The air blower pipe 37 is attached to the guide device 14 and astride of an inverting shaft 25.

Figure 12:
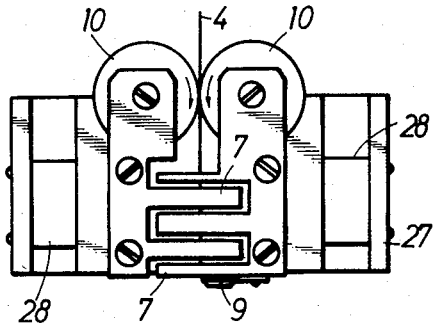
FIG. 12 is a front elevational view of the head with a cover omitted from illustration.

The grippers 7 are supported by the inverting shaft 25 on the guide device 14. The inverting shaft 25 is driven by a drive mechanism 26 to turn through 180° and move both vertically and back and forth. A head 27 is mounted on a distal end of the inverting shaft 25, and the grippers 7 are supported on guide shafts 28 in the head 27 for back-and-forth movement thereon. The grippers 7 are drivable by a drive source (not shown) such as electromagnetic plungers. As shown in FIG. 12, the grippers 7 are in the form of comb teeth and have confronting V-shaped grip surfaces 8. Theoretically, only one pair of such grippers 7 is enough as shown in FIGS. 8 and 9. However, a plurality of vertically arranged grippers 7 are preferred as shown in FIG. 12 to be able to provide an increased length of the wire 4 which is corrected. The pair of feed rollers 10 is rotatably mounted above the grippers 7 and drivable in the directions of the arrows (FIG. 12) by a motor (not shown). The cutter 9 is secured to one of the grippers 7 on its upper surface which is positioned upwardly before the grippers 7 are turned upside down. To prevent the wire 4 from being caught by the front and side surfaces of the head 27, a centrally split cover 39 having a smooth curved surface is attached to the head 27.

As illustrated in FIGS. 15 through 19, a leaf spring ring 35 is slidably mounted on an upper small-diameter end portion of the suction pipe 6. The leaf spring ring 35 is normally biased by a compression spring 36 to move toward the distal end of the suction pipe 6 into abutment against a guide collar stop 32. A pair of leaf springs 31 which is attached to the leaf spring ring 35 by attachment screws 33 is disposed in grooves 32*a* defined in the guide collar stop 32 and guided thereby for movement. The holder members 30 are affixed respectively to confronting distal ends of the leaf springs 31. The holder members 30 are made of a soft material having a large coefficient of friction such as rubber, for instance. To the distal ends of the leaf springs 31, there is also attached a pair of L-shaped positioning plates 41 disposed in confronting relation to each other and having V-shaped positioning notches 42, respectively, opening toward each other. The leaf spring ring 35 has an abutment 35*a* engageable with a stop 34 and another abutment 35*b* engageable with a limit switch 47. The stop 34 and the limit switch 47 are secured to the holer 12.

Figure 20:
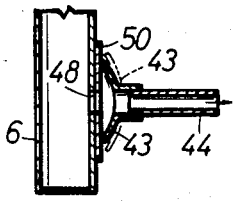
FIG. 20 is an enlarged cross-sectional view of a sucker.
Figure 21:
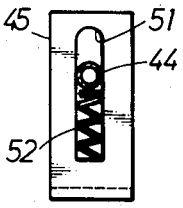
FIG. 21 is an enlarged cross-sectional view of a sucker support.
Figure 22:
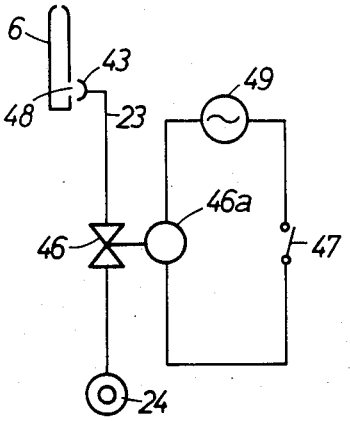
FIG. 22 is a circuit diagram of a sucker drive system.

As shown in FIGS. 10 and 20, a flat suction plate 50 is attached to a rear end of the suction pipe 6, there being a connection hole 48 defined in the suction pipe 6 and the suction plate 50. The connection hole 48 communicates with the interior of the suction pipe 6. When the suction pipe 6 is positioned in the threading step A, the connection hole 48 opens into a sucker 43. The sucker 43 is made of a soft resilient material such as rubber and attached to a distal end of a tube 44 vertically movably received in a slot 51 defined in a bracket 45 under the bias of a spring 52, the bracket 45 being attached to a side of the guide device 14. The tube 44 has a rear end connected through a flexible tube 23 and a solenoid-operated valve 46 to a source of vacuum 24. The solenoid-operated valve 46 includes a driver 46*a* such as a solenoid connected via the limit switch 47 in series with a power supply 49.

Figure 16:
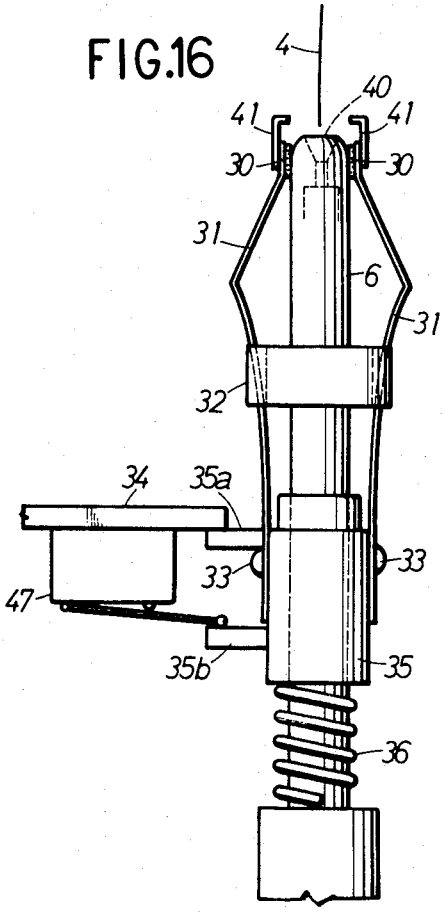
Figure 17:
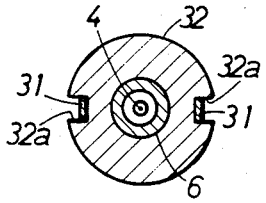
FIG. 17 is a cross-sectional view taken along line A—A of FIG. 15.
Figure 18:
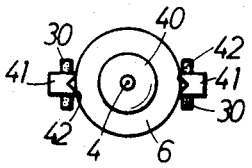
FIGS. 18 and 19 are enlarged plan views of positioning plates.
Figure 19:
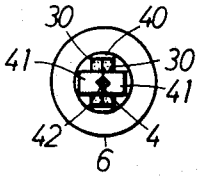

Operation of the widing apparatus 11 thus constructed is as follows:

A required length of the wire 4 is fed along by a known length-measuring and supplying unit until a distal end thereof is directed into the hole 2 from one side of the core 1. The suction pipe 6 is positioned on the other side of the core 1, that is, downwardly of the core 1, and is moved toward the core 1. On the way toward the core 1, the abutment 35*a* hits the stop 34 which then stops the leaf spring ring 35, whereupon the leaf springs 31 are spread apart along the curved distal end of the suction pipe 6 as illustrated in FIG. 16. At this time, the abutment 35*b* engages the switch 47 to turn it on, thereby opening the solenoid-operated valve 46 to cause the sucker 43 to draw ambient air toward the vacuum source 24. Since there is developed a vacuum in the sucker 43 at this time, the sucker 43 is elastically contracted into intimate contact with the suction plate 50 as shown by the solid lines in FIG. 20. Accordingly, an air stream flowing from the suction port 40 through the connection hole 48 toward the vacuum source 24 is created in the suction pipe 6. The suction pipe 6 is continuously raised until an upper end of the suction port 40 is brought into close contact with a lower surface of the core 1 around the hole 2. The air stream drawn toward the vacuum source 24 now develops a vacuum in the suction pipe 6, drawing the wire 4 through the hole 2 into the suction pipe 6 (the threading step A).

Since the suction pipe 6 is separated from the tubing associated with the vacuum source 24, the suction pipe 6 is rendered lightweight and can be swung around at a high speed. The tubing is held stationary irrespectively of any movement of the suction pipe 6, the tubing is free from the danger of getting caught by or intertangled with other surrounding components. The sucker 43 is automatically attracted to the suction pipe 6 under the vacuum from the vacuum source 24. This eliminates the need for any special controller or connector for interconnection between the suction pipe 6 and the tubing of the vacuum source 24, with the result that the overall system is rendered simple in construction.

Then, the suction pipe 6 is lowered away from the core 1, whereupon the abutment 35*a* is disengaged from the stop 34 and the leaf spring ring 35 is moved upwardly under the resiliency of the leaf spring 36. The holder members 30 are now caused to grip the drawn end of the wire 4 under the force of the leaf springs 31. During this time, the tube 44 is lowered in the slot 51 against the bias of the spring 52, allowing the sucker 43 to move the suction pipe 6 while in contact with the suction plate 50. Immediately before the holder members 30 grip the wire 4, the positioning plates 41 are brought into mutual engagement to guide the wire 4 with the positioning notches 42 into correct axial alignment with the suction pipe 6. The wire 4 can then be gripped in proper position by the holder members 30. While the suction pipe 6 is on the downward stroke, the abutment 35*b* is also disengaged from the limit switch 47, whereupon the power supply 49 is turned off to close the solenoid-operated valve 46. There is no longer any vacuum between the suction plate 50 and the sucker 43, which are then automatically separated from each other. The drive mechanism 19 in the transfer device 13 angularly moves the rotatable shaft 17 through 180° to turn the suction pipe 6 upside down until the suction pipe 6 is located upwardly of the core 1. During the inverting movement, the air blower pipe 37 discharges air through the air discharge ports 38 to direct the wire 4 downwardly at an angle of about 45° so that the wire 4 will not be entangled with surrounding machine parts. While the suction pipe 6 is moving around, the holder members 30 frictionally hold the wire 4, wind the wire 4 around the core 1 under tension, and correct the wire 4 rectilinearly. When or after the suction pipe 6 is turned, the drive unit 21 moves the slider 20 in a direction away from the rotatable shaft 17. The suction pipe 6 as it is in the upper position keeps on holding the distal end of the wire 4 therein with the holder members 30 (the transfer step B).

At the same time that the suction pipe 6 is moved away from the hole 2 in the core 1, the holder members 30 hold the drawn end of the wire 4. Accordingly, the end of the wire 4 is reliably kept in the suction pipe 6 while the latter is moving around even when the air suction force in the suction pipe 6 becomes relatively weak. The holder members 30 also serve to rectify the wire 4 rectilinearly while winding the same neatly around the core 1 without sagging. Thus, coil turns are wound on the core 1 through the hole 2 at a high density.

The inverting shaft 25 is moved forward and stopped in position, followed by the movement of the grippers 7 toward each other. At this time, the confronting grip surfaces 8 of the grippers 7 guide the wire 4 toward the central position with their slanted faces and jointly grip the wire 4 under a small force for positioning. The cutter 9 is then actuated to cut off the distal end portion of the wire 4 (the positioning step C).

Thereafter, the inverting shaft 25 is turned about its own axis through 180° to bring the feed rollers 10 from the lower position to the upper position and to guide the cut end of the wire 4 downwardly toward the hole 2 (the guiding step D). During this time, the suction pipe 6 returns to the original lower position and is readied for a next cycle of drawing a wire end. Concurrent with the starting of vacuum suction in the suction pipe 6, the grippers 7 are slightly retracted to release the wire 4. Simultaneously, the feed rollers 10 feed the wire 4 toward the hole 2, and the wire 4 reenters the suction pipe 6 through the hole 2 in the core 1. One coil turn of the wire 4 is thus wound around the core 1 through the hole 2.

The foregoing cycle of operation is repeated until a desired number of coil turns are wound around the core 1 through the hole 2. As the coil turns are successively wound on the core 1, the length of the wire 4 becomes shorter, and the drive unit 21 is actuated to move the slider 20 progressively toward the rotatable shaft 17 at a rate commensurate with the decreasing wire length.

The above series of progressive steps can be controlled by a combination of the limit switch and a sequence control circuit of a known arrangement. The solenoid-operated valve 46 may be closed at a time set by a timer switch.

Although a certain preferred embodiment has been shown and described, it should be understood that many changes and modifications may be made therein without departing from the scope of the appended claims.

What is claimed is:

1. A method of winding an electric wire around a toroidal core having a hole, comprising the steps of:

(a) guiding an end of the wire from one side of the core closely toward the hole;

(b) developing a vacuum in a suction pipe positioned on an opposite side of the core to create an air stream thereby drawing the wire through said hole from one side to the opposite side of the core;

(c) turning said suction pipe from said opposite side to said one side of said core to transfer the wire in a direction to be wound around the core;

(d) thereafter, positioning the end of the wire on said one side of the core and simultaneously cutting off the end of the wire; and (e) thereafter, guiding a cut end of the wire from said one side of the core closely toward the hole.

2. A method according to claim 1, including the step of repeating the steps (b) through (e).

3. A method according to claim 1, including the step of directing the cut end of the wire toward said hole prior to said guiding step (e).

4. A method according to claim 1, wherein said end of the wire is kept in said suction pipe and frictionally held with respect to said suction pipe during said turning step (c).

5. A method according to claim 1, wherein said end of the wire is gripped centrally by a pair of grippers during said positioning step (d).

6. A method according to claim 1, including the step of orienting said wire in a prescribed direction with an air flow during said turning step (c).

7. An apparatus for winding an electric wire around a toroidal core having a hole, comprising:

(a) a holder for holding the toroidal core in a fixed position;

(b) a suction pipe connected to a source of vacuum for drawing an end of the wire therein, said suction pipe being movable into and out of engagement with the core around the hole on one side of said core;

(c) a transfer device for turning said suction pipe with the wire end placed therein from said one side to an opposite side of said core to transfer the wire in a direction to be wound around the core;

(d) a pair of grippers for gripping said end of the wire in position on said opposite side of the core;

(e) a cutter disposed on said opposite side of the core for cutting off said end of the wire; and (f) a guide device for inverting said grippers to guide a cut end of the wire as gripped by said grippers closely toward said hole in the core on said opposite side of the core.

8. An apparatus according to claim 7, wherein said grippers have a pair of V-shaped grip surfaces confronting each other for clamping said wire centrally therebetween.

9. An apparatus according to claim 8, wherein said grippers are movable toward and away from each other, said cutter being mounted on one of said grippers.

10. An apparatus according to claim 7, wherein said transfer device includes an air blower pipe for discharging an air flow to thereby orient the wire in a prescribed direction while said wire is being transferred, said air blower pipe extending around said holder parallel to a plane in which said suction pipe is turned.

11. An apparatus according to claim 7, wherein said suction pipe has at a distal end thereof a pair of holder members for frictionally holding said wire, said holder members being slidably supported on said suction pipe by leaf springs and movable toward and away from each other by disengagement from and engagement with said distal end of said suction pipe in response to the movement of said suction pipe away from and toward said core.

12. An apparatus according to claim 7, including a suction plate attached to said suction pipe around a connection hole defined therein, and a sucker of a soft resilient material connected to said source of vacuum and elastically deformable into and out of contact with said suction plate in response to a change in pneumatic pressure generated by said source of vacuum.

* * * * *